US007124724B2

(12) United States Patent
Fleetwood

(10) Patent No.: US 7,124,724 B2
(45) Date of Patent: Oct. 24, 2006

(54) AIR-COOLED IGNITION LEAD

(75) Inventor: Charles T. Fleetwood, Easley, SC (US)

(73) Assignee: Champion Aerospace, Inc., Liberty, SC (US)

( * ) Notice: Subject to any disclaimer, the term of this patent is extended or adjusted under 35 U.S.C. 154(b) by 0 days.

(21) Appl. No.: 10/906,338

(22) Filed: Feb. 15, 2005

(65) Prior Publication Data

US 2006/0180111 A1 Aug. 17, 2006

(51) Int. Cl.
*H01T 13/00* (2006.01)
*H01T 13/05* (2006.01)

(52) U.S. Cl. ..... 123/143 C; 123/169 PH

(58) Field of Classification Search ..... 123/143 C, 123/169 PH, 169 PA; 174/24, 27–29, 25 G, 174/26 G
See application file for complete search history.

(56) References Cited

U.S. PATENT DOCUMENTS

| | | | | |
|---|---|---|---|---|
| 2,556,244 | A * | 6/1951 | Weston | 174/29 |
| 3,634,606 | A * | 1/1972 | Iyengar | 174/106 D |
| 4,074,155 | A | 2/1978 | Haditsch et al. | |
| 4,092,485 | A * | 5/1978 | Wanser | 174/28 |
| 4,266,841 | A | 5/1981 | Sherwood | |
| 4,479,029 | A | 10/1984 | Banov et al. | |
| 4,487,990 | A | 12/1984 | Lane et al. | |
| 4,705,914 | A | 11/1987 | Bondon | |
| 4,731,134 | A | 3/1988 | Alloin et al. | |
| 4,853,516 | A | 8/1989 | Julien et al. | |
| 4,866,212 | A | 9/1989 | Ingram | |
| 4,963,694 | A | 10/1990 | Alexion et al. | |
| 5,083,932 | A | 1/1992 | Wyatt et al. | |
| 5,229,543 | A | 7/1993 | Strefling | |
| 5,301,421 | A | 4/1994 | Strefling | |
| 5,317,804 | A | 6/1994 | Kasper | |
| 5,442,131 | A | 8/1995 | Borgwarth | |
| 5,670,860 | A | 9/1997 | Conrady et al. | |
| 5,742,002 | A | 4/1998 | Arredondo et al. | |
| 5,760,334 | A | 6/1998 | Ziemek | |
| 5,780,770 | A | 7/1998 | Christianson et al. | |
| 6,255,591 | B1 | 7/2001 | Ziemek | |
| 6,307,156 | B1 | 10/2001 | Avellanet | |
| 6,358,072 | B1 * | 3/2002 | Johnson | 439/126 |
| 6,439,907 | B1 | 8/2002 | Rowe | |
| 6,483,022 | B1 | 11/2002 | Packard | |
| 6,489,554 | B1 | 12/2002 | Bertini et al. | |
| 6,517,366 | B1 | 2/2003 | Bertini et al. | |
| 6,843,022 | B1 * | 1/2005 | Holley | 47/67 |

* cited by examiner

*Primary Examiner*—Mahmoud Gimie
(74) *Attorney, Agent, or Firm*—Reising, Ethington, Barnes, Kisselle, P.C.

(57) ABSTRACT

An air-cooled ignition lead for use with aircraft engines to conduct high voltage ignition pulses between an exciter and an igniter. The ignition lead includes a center conductor covered by an insulation jacket for electrical isolation. Radially spaced outwardly from the insulation jacket is a flexible conduit that has sufficient structural integrity to resist collapsing inwardly. The insulation jacket and conduit define an airflow path therebetween that is used for conducting air through the lead. An innerbraid is located over and supported by an outer surface of the flexible conduit, and this location of the innerbraid prevents it from collapsing over time and obstructing the airflow passage that extends on the inner side of the flexible conduit. The innerbraid can be used as a return path conductor that provides a return current path and/or EMI shielding. Covering the innerbraid is an outerbraid to protect the lead against external damage.

17 Claims, 1 Drawing Sheet

AIR-COOLED IGNITION LEAD

The present invention relates generally to ignition leads used with reciprocating and gas turbine engines and, more particularly, to air-cooled ignition leads used in such engines.

An ignition lead is a high voltage cable (typically 2–25 kV) used to deliver high voltage ignition pulses from an ignition system to some type of ignition device, which in turn uses the ignition pulses to generate sparks for igniting a fuel/air mixture. Most ignition leads include elastomeric components, such as grommet seals or wire insulation, for electrical isolation and improving the performance and/or durability of the ignition lead under high voltage conditions. Though helpful for these purposes, the ignition leads are typically subjected to high temperatures that can degrade and even damage the elastomeric components. If exposed to excessive temperatures for prolonged periods of time, it is possible for the elastomeric components to experience thermal degradation and breakdown of their dielectric strength. Thus, it is known in the art to provide cooling passages in the ignition leads for lowering operating temperatures, and more particularly, for reducing the heat to which the elastomeric components are exposed.

An example of a prior art air-cooled ignition lead 10 is shown in FIGS. 1A and 1B, where the ignition lead conducts a high voltage ignition pulse from an exciter (not shown) to an igniter (not shown) and generally includes a coaxial inner ignition cable comprising a center conductor 12 for the ignition pulses, an electrically insulating jacket 14, and a low-resistance braid 18 used as a return path for the electrical current. The braid 18 is spaced from the center conductor's insulation 14 by an air passage 16. All of these components are surrounded by a flexible, yet non-collapsible metal conduit 20 that provides the ignition lead with suitable structural integrity to maintain the air passage 16. The braid 18 is typically brazed at each end of the ignition lead to the conduit 20, but is not otherwise attached to it along its length. A nickel-based outerbraid 22 is provided over the conduit 20 to protect the internal components of the ignition lead from abrasion and other damage. Air is able to flow through air passage 16 such that it cools ignition lead 10, especially insulation jacket 14 which is typically made from an elastomeric or polytetrafluoroethylene-based (PTFE) material. From a conventional standpoint, locating the return path innerbraid 18 within the conduit 20 is advantageous because the conduit helps protect it from physical damage as well as electromagnetic interference. The inventors have found, however, that over time, vibration and other conditions to which the ignition lead is subjected to in normal use can cause innerbraid 18 to internally sag, collapse, and/or bunch up, in which case airflow passage 16 becomes at least partially closed off, thus inhibiting air flow through the passage. This can especially occur at one or both ends of the ignition lead wherein vibration of the ignition lead causes the braid 18 to work its way towards an end. An example of this is shown at 24 in FIG. 1B where the braid has bunched up and collapsed near an end of the ignition cable where it is attached internally to a connector or ferrule 26. This reduced cross-sectional area of the passage can reduce the cooling capability of the ignition cable which can possibly lead to high temperatures and thermal and/or dielectric breakdown of the elastomeric components.

According to one aspect of the present invention, there is provided a fluid-cooled ignition lead having a center conductor, an insulation jacket, a fluid passage, a non-collapsible conduit, a return path conductor, and an outerbraid, wherein the return path conductor is located radially outwardly of the conduit between the conduit and the outerbraid.

In accordance with another aspect of the invention, there is provided a fluid-cooled ignition lead having an insulated center conductor, a conduit radially spaced outwardly from the insulated center conductor to thereby define a fluid passage between an outer surface of the insulated center conductor and an inner surface of the conduit. The ignition lead includes a return path conductor located outside of the conduit between the conduit and an outerbraid or other protective covering.

A preferred exemplary embodiment of the invention will hereinafter be described in conjunction with the appended drawings, wherein like designations denote like elements, and wherein.

Figure 1A:
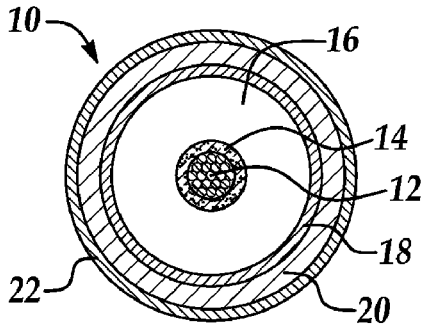
Figure 1A Prior Art
FIG. 1A is a cross-sectional view of a prior art air-cooled ignition lead.
Figure 1B:
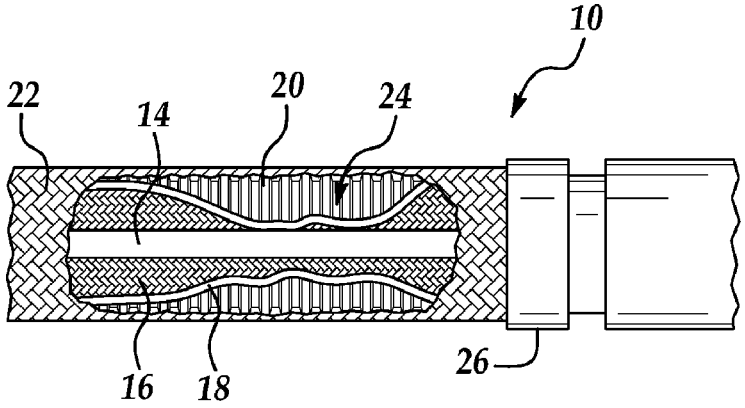
Figure 1B Prior Art
FIG. 1B is a cutaway view of an end portion of the prior art air-cooled ignition lead of FIG. 1A, wherein a component of the air-cooled ignition lead has collapsed internally.
Figure 2A:
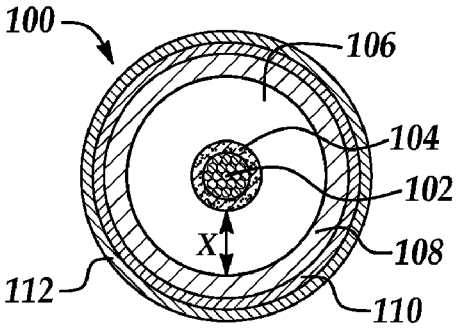
FIG. 2A is a cross-sectional view of an embodiment of the air-cooled ignition lead of this invention.
Figure 2B:
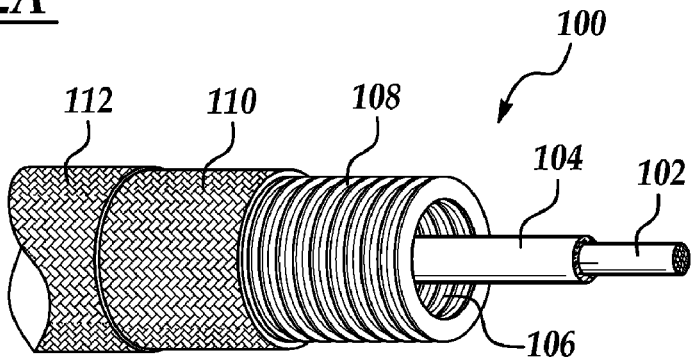
FIG. 2B is a perspective cutaway view of the air-cooled ignition lead of FIG. 2A.

Referring now to FIGS. 2A and 2B, the illustrated air-cooled ignition lead 100 is constructed to provide an air passage that allows cooling of the internal components of the ignition lead while being less susceptible to blockage of the airflow path than the prior art cable of FIGS. 1A and 1B. Ignition lead 100 can be used in conjunction with a wide array of engines, but is particularly advantageous when used with either an aircraft reciprocating or gas turbine engine. Because the present invention is primarily concerned with the structure of the ignition lead itself, no description is provided for other portions of the ignition lead that are not shown in the figures but are known in the art, such as terminal connections. The air-cooled ignition lead 100 includes at its center an insulated center conductor comprising an electrically-conductive center wire 102 and an integral insulation jacket 104. Surrounding the insulated center conductor is an airflow passage 106, a flexible conduit 108, an innerbraid 110, and an outerbraid 112, all of which are coaxially aligned about the center conductor 102.

Center conductor 102 conducts the high voltage ignition pulse provided by the ignition system, and can be comprised of either a solid core or stranded wire. In the case of a stranded wire, center conductor 102 is formed from a number of smaller gauge wires wrapped in a compact pattern such that a series of small spaces or voids are formed therebetween. Preferably, there are anywhere between 10 and 50 strands of 10 to 20 gauge wire which comprise center conductor 102. In the case of a solid core embodiment, center conductor 102 preferably includes a single wire having a uniform circular cross-section.

Insulation jacket 104 is a non-conductive sleeve or tubular sheath-like covering that coaxially surrounds center conductor 102 such that it prevents the center conductor from being inadvertently contacted and electrically shorted. In a preferred embodiment, the insulation jacket 104 has an outer diameter in the range of 3 mm to 7 mm and is comprised of an elastomeric or PTFE-based material that preferably allows any moisture trapped therein to escape.

Airflow passage 106 coaxially surrounds insulation jacket 104 and provides a cooling channel for air to flow around the jacket and acts as a heat sink for removing unwanted heat imparted to it from the aircraft engine or other nearby sources. In the particular embodiment shown here, airflow passage 106 is an elongated tubular passageway or channel having an annular cross-sectional shape, however, the cross-sectional shape could be generally oval, elliptical, rectangular, triangular, etc. The enveloping nature of airflow passage 106, with respect to insulation jacket 104, improves the thermal dynamics between these two components, as the entire outer surface of the insulation jacket is in direct thermal contact with the airflow passage. According to a preferred embodiment, airflow passage 106 has a radial dimension X, which=[(inner diameter of conduit 108–outer diameter of jacket 104)/2], and is preferably between 2 mm and 11 mm.

Alternatively, airflow passage 106 could be a fluid passage that allows a fluid, either a liquid or a gas, to flow therethrough. In either case, the liquid or gas is in fluid contact with both an inlet and outlet (neither of which are shown) such that new fluid may enter the fluid passage via the inlet, flow around and gather heat emanating through insulation jacket 104, and then exit the outlet as hotter fluid. Examples of inlets and outlets include, but are certainly not limited to, tapered sleeves, openings, bosses, valves, manifolds, etc., and could include those terminal connections conforming to SAE/ARP standard 670, types 1–4. Because the ignition lead of this invention can be utilized with one of a number of inlets and outlets and is not linked to any one particular design, and because such inlets and outlets are known in the art, a further explanation of them has been omitted.

Flexible conduit 108 provides air-cooled ignition lead 10 with some structural integrity such that it is flexible, yet non-collapsible. By "non-collapsible", it is meant that conduit 108 will not collapse inwardly except under an applied force that is substantially in excess of that normally encountered by the ignition lead when used in its intended environment. According to a preferred embodiment, flexible conduit 108 is a tubular structure that defines the outer extent of airflow passage 106 and prevents the air flowing through the ignition lead from escaping outwardly through the conduit. Preferably, the flexible conduit 108 is formed from a Nickel-iron (Ni—Fe) material which can include other constituent elements and which can be in the form of an alloy or as nickel-cladded iron. Other metals and compounds can be used as long as they provide sufficient structural integrity to render the conduit non-collapsible. The airflow passage 106 terminates radially outwardly at an inner cylindrical surface of flexible conduit 108 which according to a preferred embodiment has an inner diameter that is between 10 mm–30 mm.

Innerbraid 110 is a low resistance, sleeve-like component that provides a low resistance return path for the ignition lead. This braided return path conductor is useful for providing EMI shielding and/or as a return path for ignition pulse current supplied via the center conductor, as will be appreciated by those skilled in the art. In a preferred embodiment, innerbraid 110 is a braid of nickel-plated copper wire that coaxially surrounds flexible conduit 108 in tight contact therewith. Outerbraid or overbraid 112, while potentially useful also as a ground path, is a protective covering made from nickel wire that surrounds the other components of ignition lead 100 and that is used primarily to provide external protection of the innerbraid and other components from damage such as abrasion. Experience has shown that without an outerbraid, engine vibration and other operating conditions can cause rubbing or abrasion by clamps or other fastening devices that hold the ignition lead in place.

In use, air-cooled ignition lead 100 is connected between an ignition system such as an exciter (not shown) and a sparking device such as an igniter (not shown), such that the exciter provides the igniter with high voltage ignition pulses via the ignition lead. As the temperature of the ignition lead rises due to heat from the engine and/or other nearby sources, air flowing through airflow passage 106 acts as a heat sink and removes the heat, thereby helping to protect the insulation jacket 104. The heated airflow is then transported to some type of outlet which vents the hot air to the atmosphere, such that the overall temperature of ignition lead 100 can be kept to an acceptable level. Of course, in the case of a fluid flow passage carrying a liquid coolant, the imparted heat would be removed from the liquid coolant in a manner similar to that used by a radiator, and the cooled liquid would then be recirculated through the fluid passage.

It is to be understood that the foregoing description is not a definition of the invention itself, but is a description of one or more preferred exemplary embodiments of the invention. The invention is not limited to the particular embodiment(s) disclosed herein, but rather is defined solely by the claims below. Furthermore, the statements contained in the foregoing description relate to particular embodiments and are not to be construed as limitations on the scope of the invention or on the definition of terms used in the claims, except where a term or phrase is expressly defined above or where the statement specifically refers to "the invention." Various other embodiments and various changes and modifications to the disclosed embodiment(s) will become apparent to those skilled in the art. All such other embodiments, changes, and modifications are intended to come within the scope of the appended claims.

As used in this specification and claims, the terms "for example" and "such as," and the verbs "comprising," "having," "including," and their other verb forms, when used in conjunction with a listing of one or more components or other items, are each to be construed as open-ended, meaning that that the listing is not to be considered as excluding other, additional components or items. Other terms are to be construed using their broadest reasonable meaning unless they are used in a context that requires a different interpretation.

What is claimed is:

1. A fluid-cooled ignition lead, comprising:

a center conductor for conducting high voltage ignition pulses;

an insulation jacket surrounding said center conductor;

a flexible conduit surrounding said insulation jacket and being spaced from said jacket such that said ignition lead includes a fluid passage located between said insulation jacket and said conduit;

a low-resistance return path conductor comprising a plurality of low resistance metal wires located radially outwardly of said flexible conduit; and a protective covering surrounding said return path conductor.

2. The ignition lead of claim 1, wherein said center conductor, insulation jacket, fluid passage, flexible conduit, return path conductor, and protective covering are all generally coaxial with each other.

3. The ignition lead of claim 1, wherein said return path conductor comprises an innerbraid of copper-cored wires and said protective covering comprises an outerbraid of nickel-based wire.

4. The ignition lead of claim 1, wherein said fluid passage has a radial dimension X that is between 2 mm and 11 mm.

5. The ignition lead of claim 1, wherein said fluid passage has a generally annular cross-sectional shape.

6. The ignition lead of claim 1, wherein said flexible conduit is a non-collapsible, metal conduit.

7. The ignition lead of claim 1, wherein said fluid passage is defined in part by said flexible conduit.

8. The ignition lead of claim 7, wherein said fluid passage extends radially from an outer surface of said insulation jacket to an inner surface of said flexible conduit.

9. A fluid-cooled ignition lead, comprising:

a center conductor;

an insulating sleeve covering said center conductor and having an outer surface;

a non-collapsible conduit surrounding said insulating sleeve, said conduit having an inner surface and being spaced from said insulating sleeve, whereby said inner surface of said conduit and said outer surface of said insulating sleeve together define a fluid passage therebetween, said fluid passage extending radially from said insulating sleeve to said conduit and extending axially along a length of said insulating sleeve, whereby fluid flowing through said fluid passage is in direct contact with said insulating sleeve and said conduit;

a return path conductor located radially outwardly of said conduit; and an outerbraid covering said return path conductor and providing an abrasion-resistant outer surface of said ignition lead, wherein said return path conductor has a lower electrical resistance than said outerbraid.

10. The ignition lead of claim 9, wherein said center conductor, insulating sleeve, fluid passage, conduit, return path conductor, and outerbraid are all generally coaxial with each other.

11. The ignition lead of claim 9, wherein said return path conductor comprises an innerbraid of copper-cored wires.

12. The ignition lead of claim 9, wherein said fluid passage has a radial dimension X that is between 2 mm and 11 mm.

13. The ignition lead of claim 9, wherein said fluid passage has a generally annular cross-sectional shape.

14. The ignition lead of claim 9, wherein said fluid passage is defined in part by said conduit.

15. The ignition lead of claim 9, wherein said return path conductor comprises a braid of nickel plated copper wire.

16. An air-cooled ignition lead for use with an ignition system and a sparking device, comprising:

an elongated center conductor for conducting high voltage ignition pulses between the ignition system and sparking device;

an insulation jacket coaxially surrounding said center conductor and having an outer cylindrical surface;

a flexible conduit coaxially surrounding said insulation jacket and having an inner cylindrical surface;

an airflow passage for allowing air to flow within said ignition lead, said airflow passage being located coaxially between said insulation jacket and said flexible conduit, with said airflow passage having an annular cross-sectional shape and extending radially from said insulation jacket for a distance of between 2 mm and 11 mm;

a copper-cored innerbraid coaxially surrounding said flexible conduit; and a nickel-based outerbraid coaxially surrounding said innerbraid;

wherein said airflow passage is bounded on a radially-inward side by said insulation jacket outer cylindrical surface and on a radially-outward side by said flexible conduit inner cylindrical surface, such that air flowing in said airflow passage is in direct contact with said insulation jacket outer cylindrical surface to thereby remove heat from said insulation jacket.

17. In a fluid-cooled ignition lead having an insulated center conductor and an outer covering assembly radially spaced from said insulated center conductor by a fluid passage, said outer covering assembly comprising an innerbraid, a flexible conduit, and an outer protective covering surrounding said conduit, innerbraid, and insulated center conductor, wherein the improvement comprises said innerbraid being located between said flexible conduit and said protective covering, and said flexible conduit defining in part said fluid passage.

* * * * *